US005897036A

United States Patent [19]

DeCoster et al.

[11] Patent Number: 5,897,036

[45] Date of Patent: Apr. 27, 1999

[54] DISPENSING SEAL

[75] Inventors: Pieter K. J. DeCoster, Aalst; Robert H. C. M. Daenen, Essene, both of Belgium

[73] Assignee: Dart Industries Inc., Orlando, Fla.

[21] Appl. No.: 08/832,537

[22] Filed: Apr. 3, 1997

[51] Int. Cl.[6] ..... B67D 3/00

[52] U.S. Cl. ..... 222/480; 222/482; 222/545

[58] Field of Search ..... 222/482, 485, 222/486, 480, 545, 565, 483

[56] References Cited

U.S. PATENT DOCUMENTS

| | | | |
|---|---|---|---|
| D. 167,142 | 7/1952 | Goldrosen . | |
| D. 274,030 | 5/1984 | Daenen et al. . | |
| D. 277,724 | 2/1985 | Daenen et al. . | |
| D. 340,188 | 10/1993 | Forsyth . | |
| 2,045,855 | 6/1936 | Hovey . | |
| 2,704,623 | 3/1955 | Yasso . | |
| 3,246,792 | 4/1966 | Brackmann et al. . | |
| 3,262,606 | 7/1966 | Waterman | 222/480 |
| 4,723,693 | 2/1988 | DeCoster . | |
| 4,892,217 | 1/1990 | Shastal . | |
| 4,895,298 | 1/1990 | Reil . | |
| 4,949,865 | 8/1990 | Turner . | |
| 4,969,574 | 11/1990 | Shastal . | |
| 5,083,671 | 1/1992 | Hayes . | |
| 5,244,113 | 9/1993 | Stymiest | 222/545 |
| 5,330,082 | 7/1994 | Forsyth | 222/480 |
| 5,509,582 | 4/1996 | Robbins, III . | |

*Primary Examiner*—Philippe Derakshani
*Attorney, Agent, or Firm*—John A. Doninger; Taylor J. Ross

[57] ABSTRACT

A closure base mountable to a container presents two ports individually and selectively sealed and opened by overlying lids. The ports having unobstructed pouring zones, and the lids having coplanar upper surfaces and integral positioning ears for resiliently retaining each lid in both an open and closed position.

6 Claims, 6 Drawing Sheets

DISPENSING SEAL

BACKGROUND OF THE INVENTION

The invention is broadly concerned with containers for foodstuffs, particularly containers for home storage of bulk materials such as condiments, cereals, pasta shapes, and in fact any flowable material which would normally be poured or scooped from the container.

The most practical types of such containers, and those having found substantial acceptance in the marketplace, are both large and small oval containers, as well as the more standard round container, all of which are easily stored either in kitchen cabinets or refrigerators and which are normally adapted for stacking. This stacking feature is encouraged by the formation of the seal with a central depression adapted to receive the bottom of a superimposed container.

In order to enhance the practicality of such containers, it has been proposed to provide the seal assembly with dual dispensing lids, each lid allowing selective access to a specifically configured discharge port. One example of such a seal assembly will be noted in DeCoster, U.S. Pat. No. 4,723,693, commonly owned with the present application.

SUMMARY OF THE INVENTION

The present invention is specifically concerned with an enhanced seal or seal assembly providing dual independently manipulable closure lids allowing selected access to the interior of the container for a dispensing of the contents in accord with the nature of the contents. For example, if the contents comprise fairly large components, such as shaped pastas, dry cereals and the like which are to be dispensed in rather large volumes, the corresponding dispensing port will comprise a large opening. The companion port will usually have one or more smaller openings, allowing alternate use of the same container for materials to be dispensed in smaller increments, such as spices or condiments.

The seal, notwithstanding the provision of dual closure lids, presents a planar recessed upper surface which retains the desired stackability for the containers and is easily cleaned.

Other significant features of the invention include the provision of specifically configured pouring edges for the ports which are so shaped as to direct the flow of the contents through the seal for an unencumbered discharge thereof and in a manner which avoids any trapped or caught residue at the pouring edge. This is particularly significant with regard to foodstuffs such as sugar, finely crushed breadcrumbs, and the like.

Provision is also made to retain each lid in its open or pouring position without requiring continuous manual engagement therewith. In other words, upon a manual opening of the lids to the full open position thereof, the lids will remain open until physically closed. The actual means by which the lids are retained in the open or pouring position comprises one or more extension tabs on each lid coplanar with the corresponding lid and projecting beyond the pivot line or hinge of the lid. Upon a physical opening of the lid and a movement of the lid toward an overcenter position beyond the plane of the hinge, the tab or tabs will, through engagement with the underlying surface of the seal assembly base, flex out of the plane of the corresponding lid to move to the opposite side of the hinge, at which point the tab or tabs will return to a position coplanar with the lid and, through a direct bearing on the underlying base surface, preclude a return of the lid to the closed position without positive manual force. The flexibility of the tab or tabs results from the inherent flexible resiliency of the synthetic resinous material of the lid. While a positive retention of the open lid is achieved, the actual pressure required for a pivotal movement of the lid to and from the closed position will be such as to cause no inconvenience or difficulty to the average homemaker.

Basically, the seal assembly includes a flanged base configured to snap lock to the rim of the appropriate container and present a recessed planar base panel having dispensing openings or ports adjacent the opposed ends thereof. In addition to the opposed dispensing ports, the base panel is usually provided with a plurality of mounting apertures which receive mounting studs depending from a substantially planar overlying cap.

The overlying cap, presenting substantially planar upper and lower surfaces, includes a pair of closure lids at the opposed ends thereof selectively receivable within the dispensing ports upon a mounting of the cap over the flanged base with the studs within the apertures. The lids include depending sealing flanges adapted to engage within the corresponding dispensing ports for a peripheral sealing thereof. In addition, each lid includes an upward and outward extending integral handle for easy manipulation thereof. The mounted cap, with the lids closed, has its planar upper surface below the upper edge of the peripheral flange on the base to retain the desired stackability, notwithstanding the provision of dual lids.

Other features, advantages and objects of the invention will become apparent from the more detailed description of the invention following hereinafter.

DESCRIPTION OF PREFERRED EMBODIMENTS

Referring now more specifically to the drawings, and in particular FIGS. 1–10, the seal or seal assembly 20 illustrated therein is intended to mount on a typical stacking container 22 of the type normally referred to as an "oval" container. As a practical matter, such containers, and hence the seal assembly 20, can be more specifically described as oblong.

Figure 5:
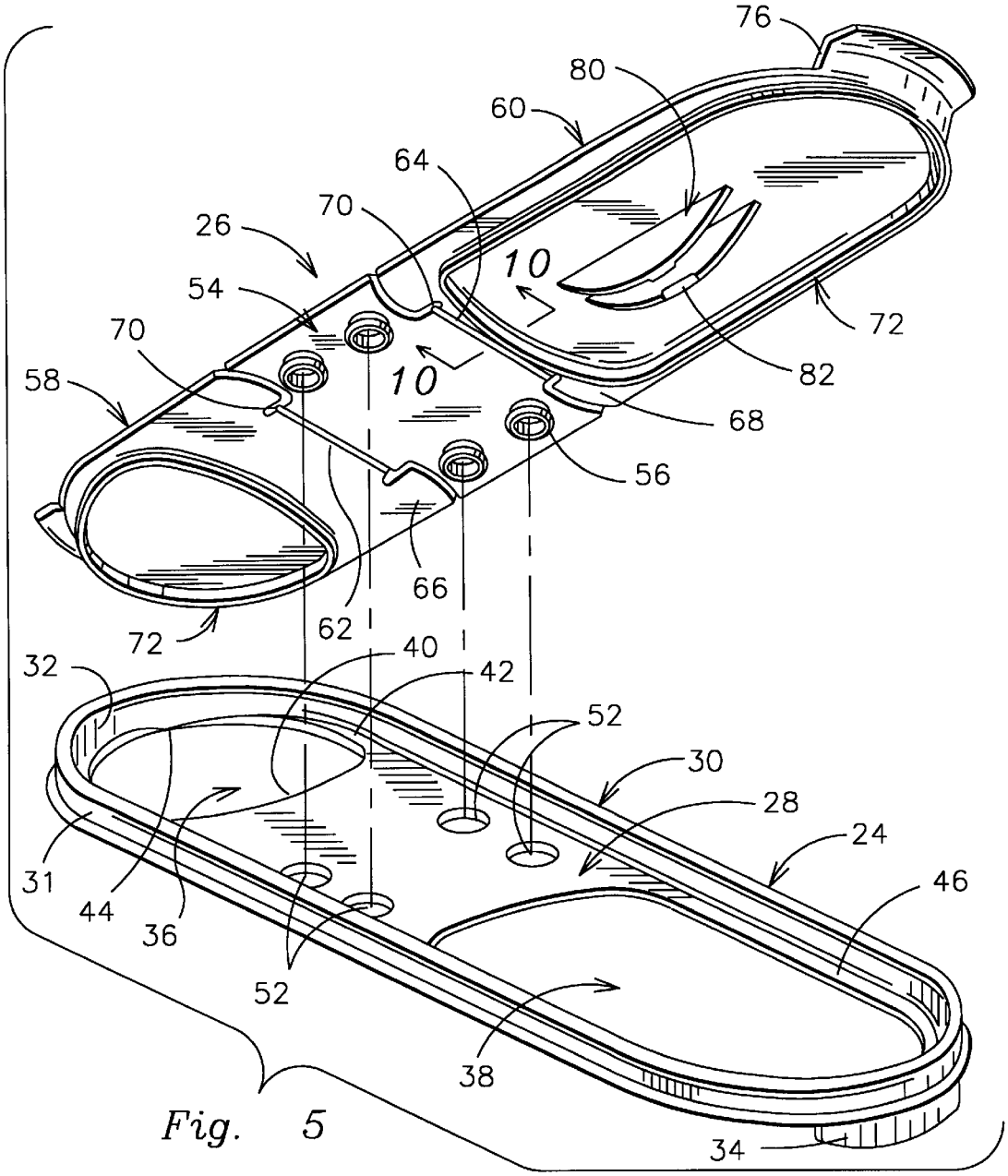
FIG. 5 is an exploded perspective view of the flanged base and the cap which comprise the seal assembly.
Figure 6:
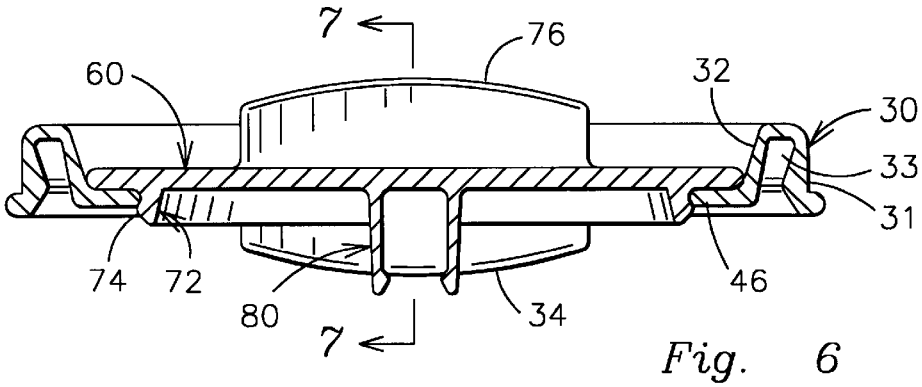
FIG. 6 is an enlarged cross-sectional view taken substantially on a plane passing along line 6—6 in FIG. 1.
Figure 7:
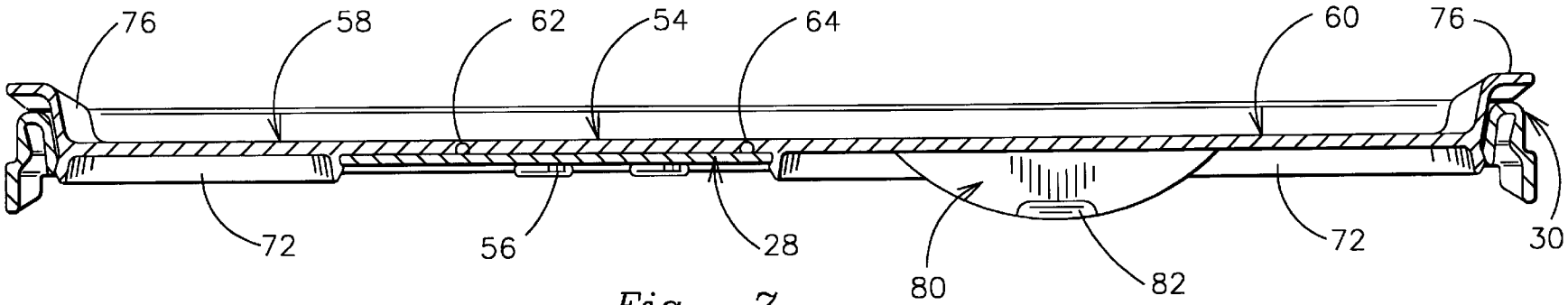
FIG. 7 is an enlarged longitudinal cross-sectional view taken substantially on a plane passing along line 7—7 in FIG. 6.
Figure 9:
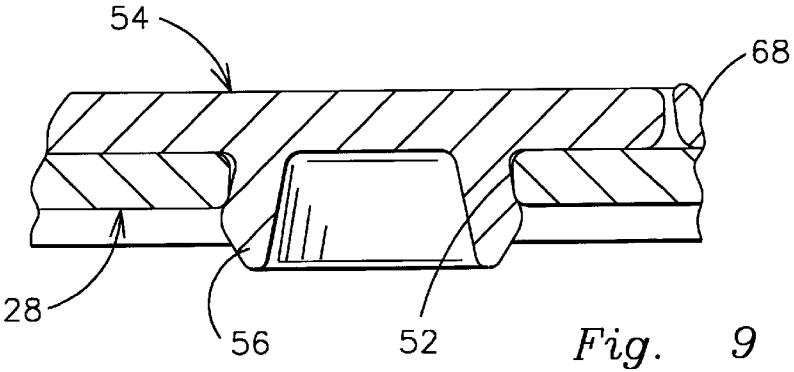
FIG. 9 is an enlarged cross-sectional detail taken substantially on a plane passing along line 9—9 in FIG. 1 and illustrating a mounting stud.
Figure 10:
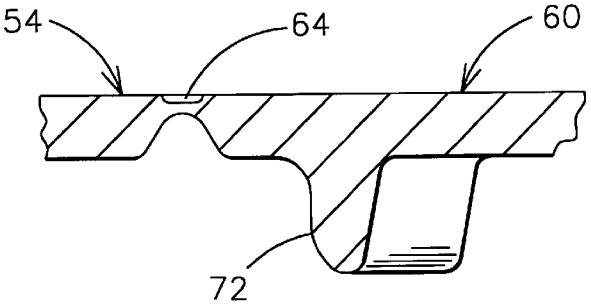
FIG. 10 is an enlarged cross-sectional detail taken substantially on a plane passing along line 10—10 in FIG. 5 and illustrating a typical hinge construction.

The seal assembly 20, noting FIG. 5, includes a lower flanged base 24 and an upper closure cap 26. The base 24 includes a planar base panel 28 with upper and lower surfaces and an integral peripheral upwardly extending continuous flange 30 thereabout. The flange 30, between outer and inner walls 31 and 32 thereof, defines a downwardly directed peripheral groove 33 which receives and snap-locks to an upper rim (not shown) on the container 22 in a conventional manner. The grooved flange 30 will preferably provide a fluid-tight seal to the container. As desired, appropriate lifting tabs 34 can be provided integral with the outer wall of the flange 30 at and along the opposed ends of the base 24 to facilitate selective removal of the base, either with or without the closure cap 26 mounted thereto.

The base 24 has a pair of dispensing ports or port openings 36 and 38 defined through the base panel 28 at the opposed arcuate or semi-circular end portions thereof. The port 36 is smaller than the port 38 with the size of the ports intending to accommodate the dispensing of a relatively wide range of products, either by a direct pouring therethrough or through the use of a scoop or other appropriate implement.

Of particular significance is the configuration of and manner in which each port is defined within and by the base panel 28 and the inner wall 32 of the flange 30. Specifically, and noting the smaller port 36, the panel 28 from the wide inner edge 40 of the port extends along the opposed sides of the port 36, as at 42, and progressively tapers or narrows to a pouring point or small area 44 wherein the port 36 is defined solely by the inner face of the inner wall 32 of the flange 30. Noting FIG. 8, the inner wall 32, at a point or zone designated by reference numeral 44, has no inwardly projecting portion of the base panel 28 thereat, and as such, a free and unimpeded flow of material from the container 12 can be achieved. As the container is tipped for pouring in the normal manner, the material, guided by the tapering or narrowing portions 42 of the panel 28 to the opposite sides of the port 36 will downwardly flow to the unencumbered pouring point 44 whereat the material will freely flow from the container without a "catching" of the material on any overhanging lip or the like, and without a buildup of residue at the pouring point.

The dispensing port 38, while substantially longer than the port 36, is similarly formed with the base panel 28 extending along the opposed sides thereof as at 46 and progressively tapering, either along the full length thereof or toward the arcuate end of the port 38, to a pouring point or small area 48 whereat the base panel 28 disappears. The base panel 28, or more particularly the side portions 46 thereof in effect terminates immediately adjacent the point or zone 48 to provide an unencumbered area defined solely by the inner surface of the inner wall 32 of the flange 30.

Figure 1:
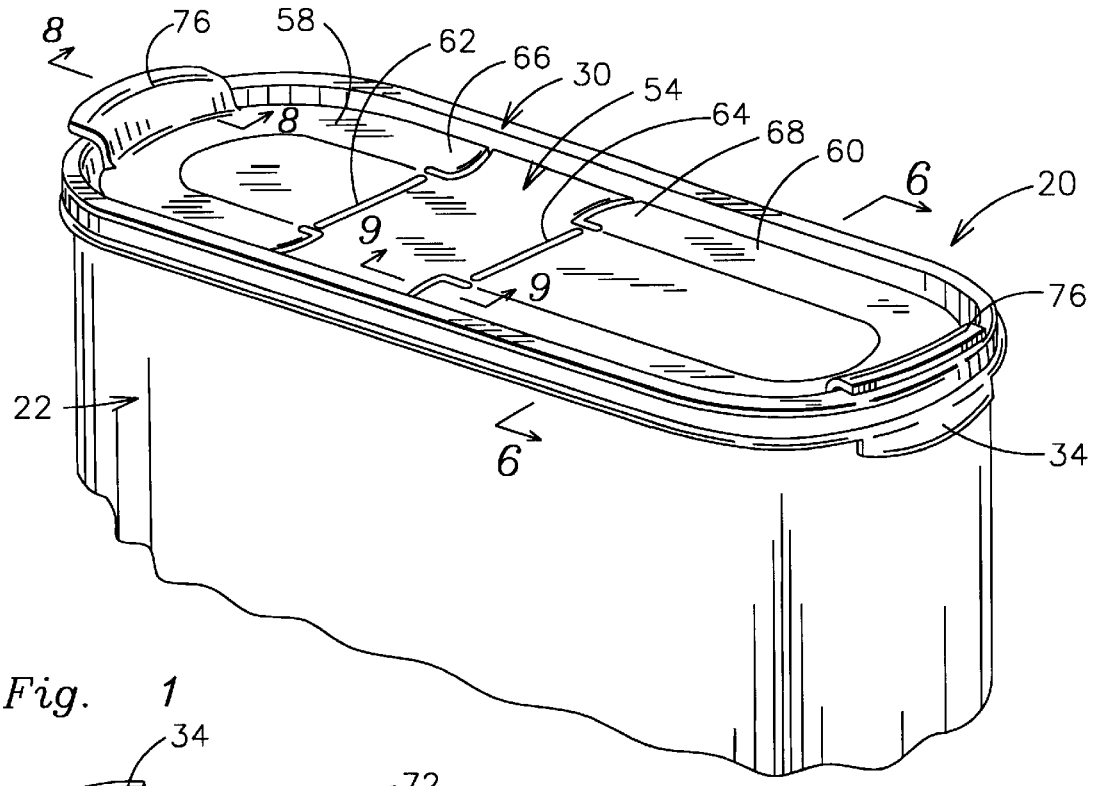
FIG. 1 is a perspective view of the upper portion of a container with the seal assembly of the invention mounted thereon.
Figure 2:
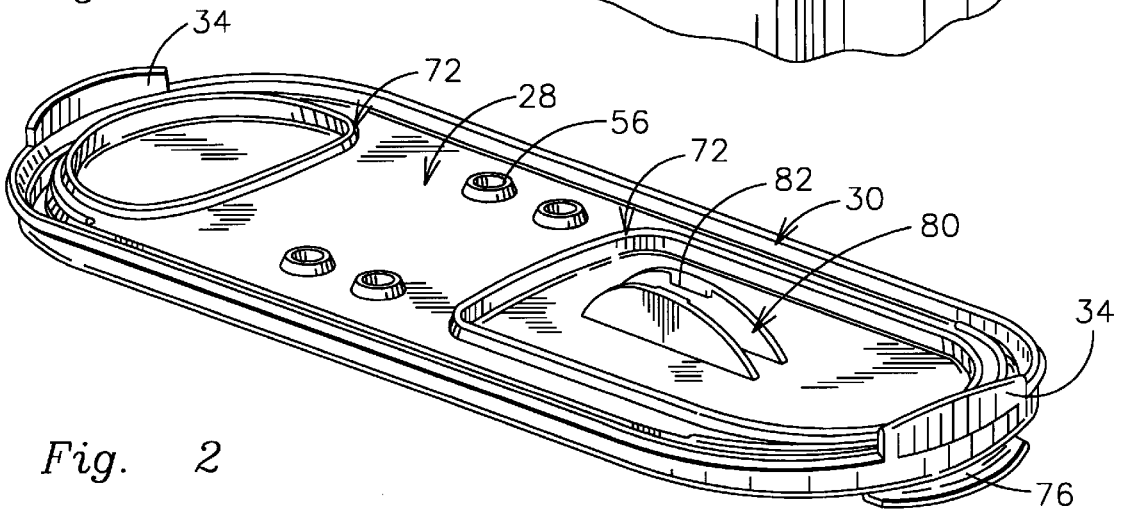
FIG. 2 is an inverted perspective view of the seal assembly.
Figure 3:
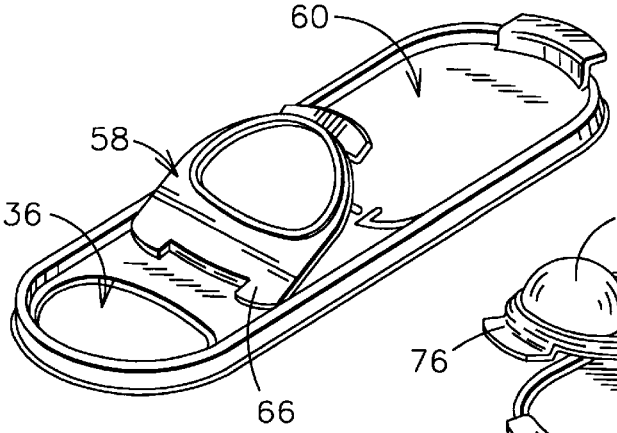
FIG. 3 is a top perspective view with one of the closure lids in its fixed open position.
Figure 8:
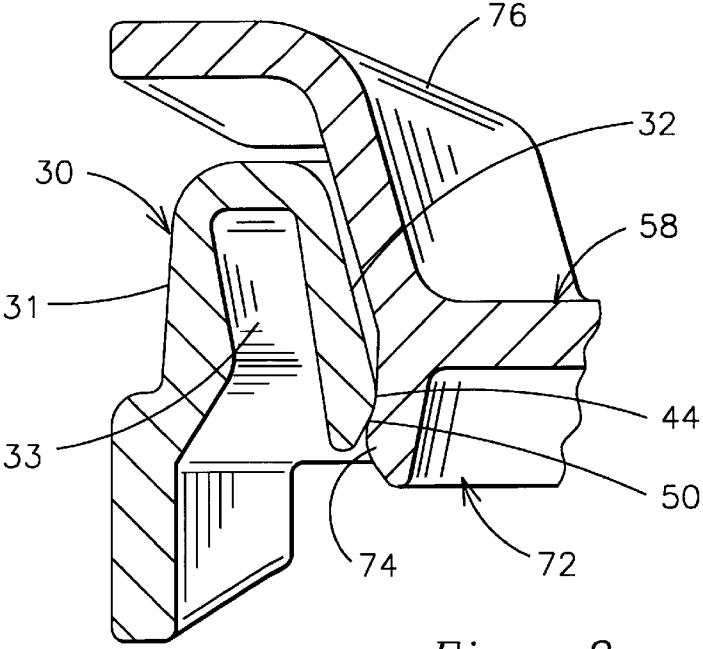
FIG. 8 is an enlarged cross-sectional detail taken substantially on a plane passing along line 8—8 in FIG. 1.

FIG. 8, while designated as a sectional detail on line 8—8 in FIG. 2, is also in fact a detail at the similarly formed area at pouring zone 48. As will be noted, the inner flange wall 32 slopes upward and outward from a slight undercut 50 at the lower inner corner thereof. The base panel portions 46 along the opposite sides of the port 38, as with the side portions 42, act as an effective guide for the material as it is being poured with the material guiding toward the discharge zone 48 for an unencumbered flow of the material without any lips or other obstructions at the zone 48 as might disrupt the discharge flow or collect residue.

The flanged base 26, in addition to providing specifically configured and enhanced dispensing ports 36 and 38, also directly mounts the overlying closure cap 26 through the provision of several, four in the illustrated embodiment, mounting apertures 52 through the planar base plate 28.

The cap 26 is configured for close conforming reception on the base plate 28 within the peripheral flange 30. The cap 26 comprises a planar central mounting plate 54 with four mounting studs 56 depending therefrom and adapted to snap lock in and through the base panel apertures 52 with the mounting panel 54 in supported overlying relation to the base panel 28 between the base panel ports 36 and 38.

Integral with the central mounting panel 54 of the cap 26, and extending longitudinally beyond the opposed ends thereof, are a pair of closure lids 58 and 60. The lids 58 and 60 correspond to and overlie the ports 36 and 38 with each lid pivotally integral with the central mounting panel 54 through a living hinge 62 and 64 respectively. These hinges extend transversely of the cap 26 across a central portion thereof between the opposed side edges of the cap which are defined by the aligned side edges of the central mounting panel 54 and the lids 58 and 60.

Each of the lids 58 and 60 includes a pair of integral coplanar positioning extensions or ears to the opposite ends of the linear hinges 62 and 64. The ears associated with the lid 58 are designated by reference numeral 66, while the ears associated with the lid 60 are designated by reference numeral 68. Each set of ears 66 and 68 extend beyond the corresponding linear hinge 62 and 64 respectively to the opposite side thereof from the corresponding main body of the lid and, in each instance, terminate in slightly arcuate free outer edges. The ears 66 and 68 are intended to retain the corresponding lids in both a closed sealing position and an open dispensing position upon manual movement of the lids to either position. Basically, and as suggested in FIGS. 3 and 4, as either lid, 58 or 60, is moved to an open position, the corresponding ears 66, 68 will flex sufficiently as to allow for a sliding movement along the underlying base panel 28 of the base 24 until such time as the ears snap back into coplanar relationship with the corresponding lid. The lid, at that point, will be overcenter relative to the corresponding hinge and angled at an acute angle to the underlying base 24 away from the dispensing port, 36 or 38. In this position, the ears will retain the lid open to allow for a free dispensing of the contents of the container 22 until such time as the lid is physically moved to a closed position against the biasing force of the corresponding ears. The ears, in turn, will again slide along the underlying base panel 28 and return to a position coplanar with the corresponding lid as the lid is closed.

The resilient flexibility of the ears results from inherent properties of the synthetic resinous materials used in the formation of the cap 26, and particularly the lids 58 and 60. The necessary spring flexing of the ears is facilitated by extending the effective length of the ears into the body of the corresponding lid relative to the corresponding hinge line 62 by means of a cut line 70 along the inner edge of each ear 66, 68 as will best be noted in FIG. 5. Formed in this manner, each of the ears 66, 68 is integral with the corresponding lid along an imaginary fold line inward of the corresponding hinge to ensure an appropriate resilient flexure of the ears as the lid moves between the two positions thereof.

In order to effectively seal the dispensing ports 36 and 38 in the closed positions of the lids 58 and 60, each lid, on the undersurface thereof, includes a depending sealing flange 72. Each of these lid sealing flanges 72 is configured to conform to the periphery of the corresponding port and snap-lock into sealing engagement with the peripheral edge thereof completely thereabout. Noting FIGS. 6, 7 and 8, it will be seen that the lid sealing flange 72 includes, peripherally about the outer surface thereof, a sealing projection or rib 74 which snap-engages, in a sealing manner, immediately below those portions of the edges of the base panel 28 which define the ports 36 and 38, including the tapering side extensions 42 and 46 which form the side edges of the ports. Noting FIGS. 7 and 8 in particular, it will also be seen that the lid sealing flange rib 74 also snap-engages with the inner wall 32 of the base flange 30 at the pouring zone or area 44, 48 across which the base panel 28 does not continue, with the rib 74 mating with and sealing against the inclined lower edge portion 50 of the inner wall 32 of the flange 30. It will also be noted that each of the lid sealing flanges 72 inclines or flares slightly outward as it depends from the overlying lid 58, 60 to facilitate a proper engagement with the periphery of the corresponding dispensing port 36, 38.

Inasmuch as the upper surface of the closure cap 26 is flat or planar, the upper surfaces of the lids 58 and 60 being coplanar with the upper surface of the central mounting panel 58, closed containers can be readily stacked, notwithstanding the versatile dispensing capability provided with the dual lid seal assembly of the invention. In order to facilitate the selective opening of the lids 58 and 60, each lid, at the outer arcuate portion of the periphery thereof, is provided with a relatively short arcuate upward and outward extending lifting handle 76 which preferably extends over the peripheral base flange 30 for easy access thereto.

Figure 4:
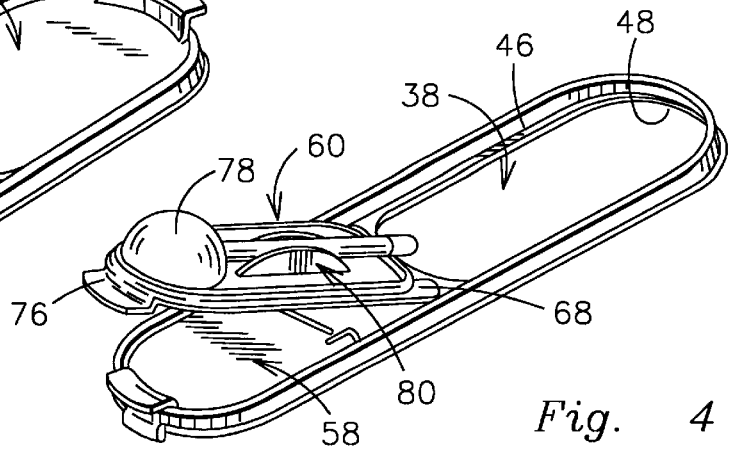
FIG. 4 is a top perspective view of the seal assembly with the second closure lid in its fixed open position.

As illustrated, the dispensing port 38 is relatively large and can be used to retrieve the contents of the container 22 by the use of a handled scoop 78, note FIG. 4. As it will be desirable to make such a scoop readily available, the undersurface of the larger lid 60 can include a pair of integral depending parallel retaining projections 80 with inwardly extending outer edge tabs 82 which frictionally receive and retain the handle of the scoop 78 therebetween. The size and positioning of the scoop 78 will of course be such as to allow for a complete closing of the corresponding lid 60 with the retained scoop 78 protectively enclosed with the container.

Figure 11:
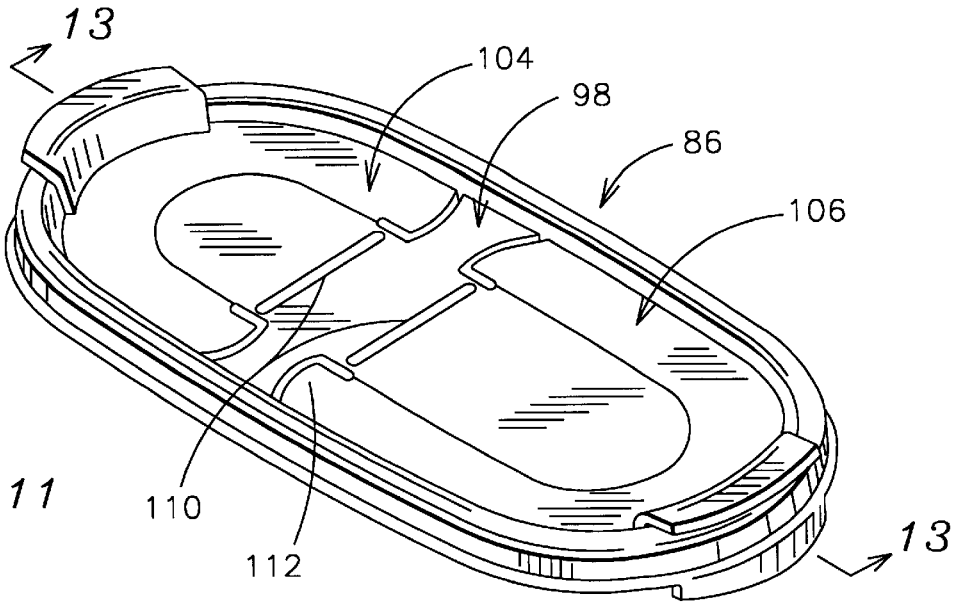
FIG. 11 is a top perspective view of a smaller second embodiment of a seal assembly.
Figure 12:
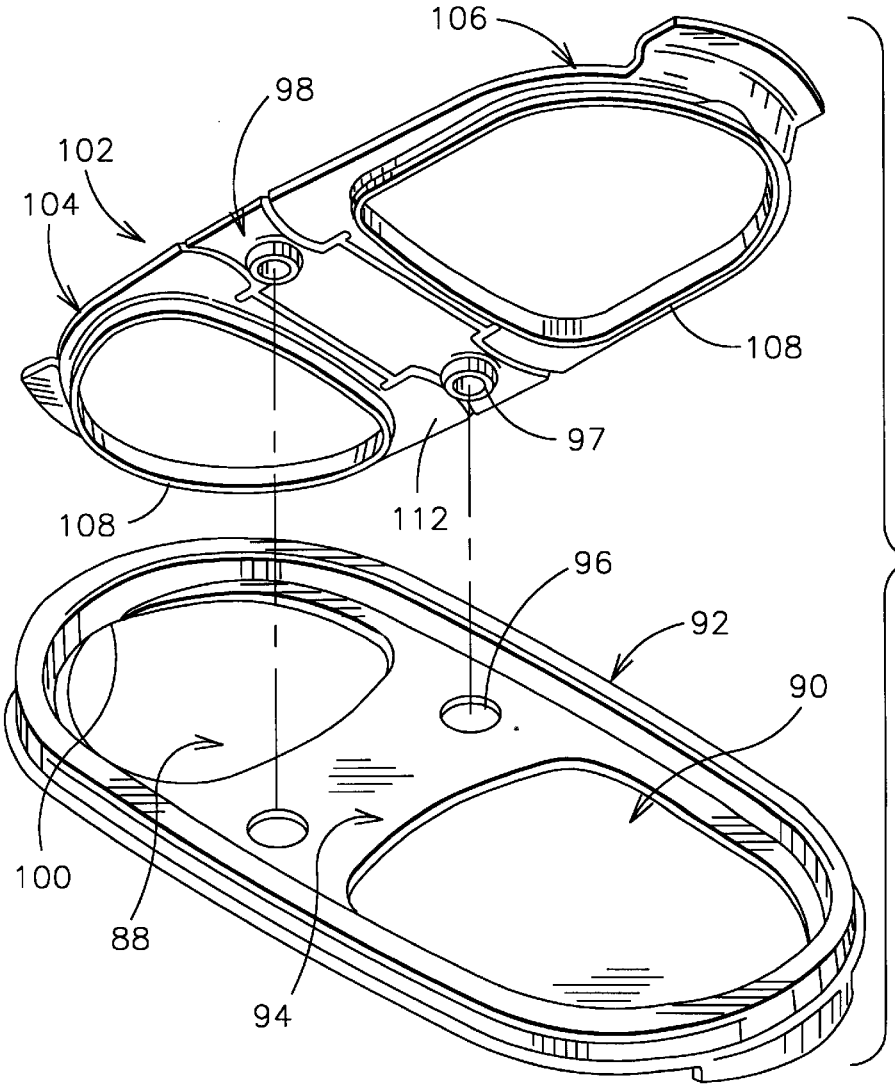
FIG. 12 is an exploded perspective view of the flanged base and cap of the seal assembly of FIG. 11.
Figure 13:
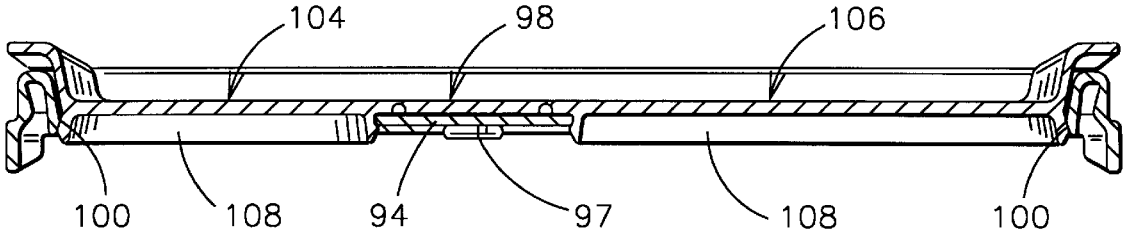
FIG. 13 is an enlarged cross-sectional view taken substantially on a plane passing along line 13—13 in FIG. 11.
Figure 14:
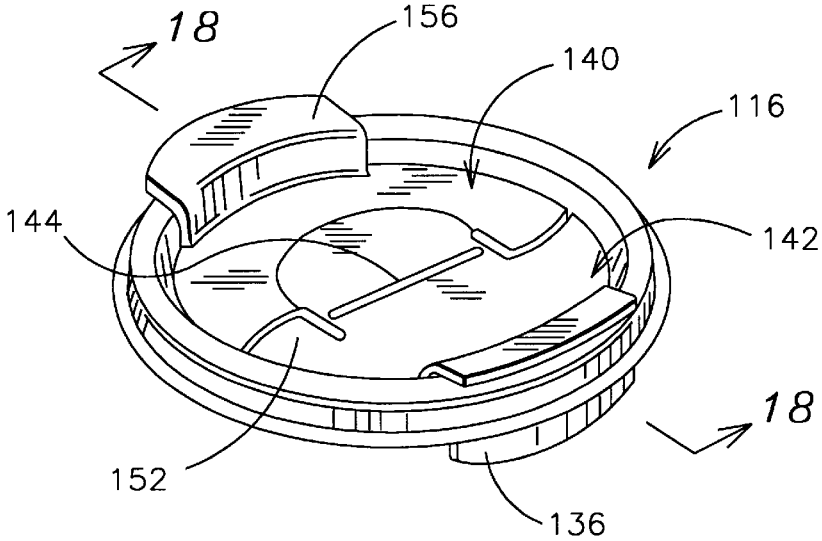
FIG. 14 is a top perspective view of a round seal assembly comprising a further embodiment of the invention.
Figure 15:
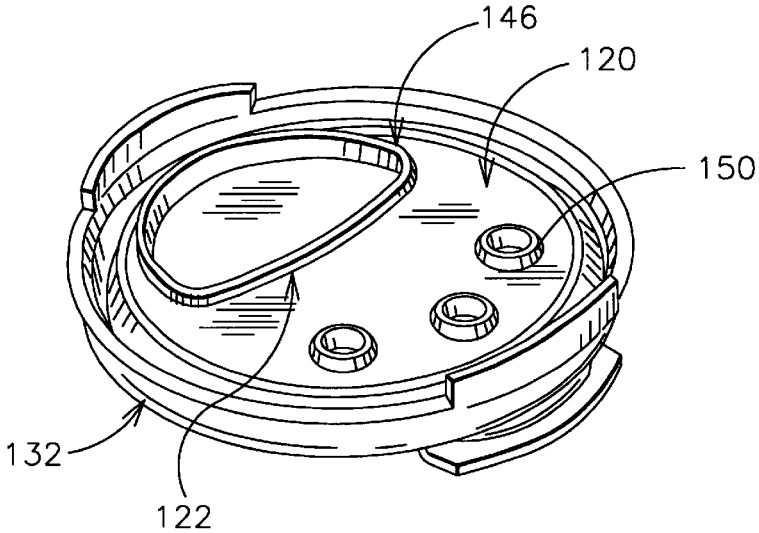
FIG. 15 is a bottom perspective view of the seal assembly on FIG. 14.
Figure 16:
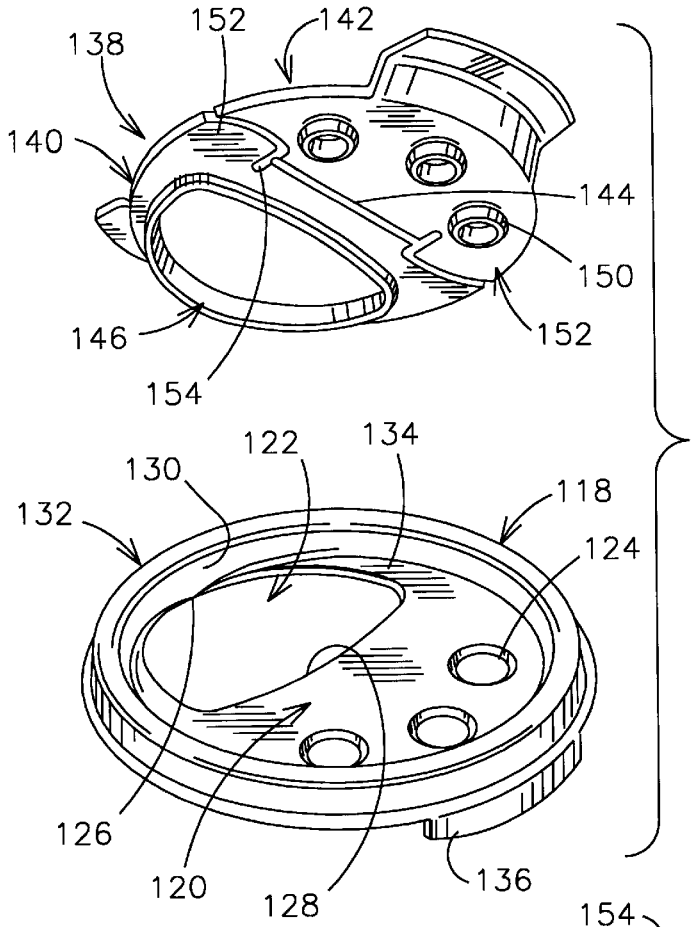
FIG. 16 is an exploded perspective view of the flanged base and cap of the round seal assembly.
Figure 17:
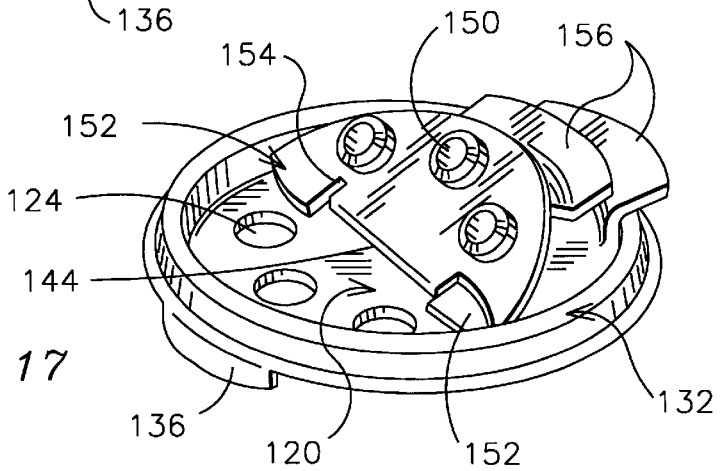
FIG. 17 is a top perspective view of the round seal assembly with one of the closure lids in its fixed open position.
Figure 18:
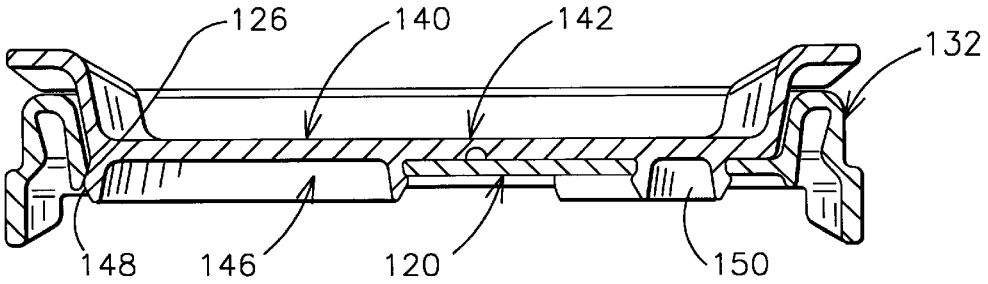
FIG. 18 is an enlarged cross-sectional detail taken substantially on a plane passing along line 18—18 in FIG. 14.

FIGS. 11, 12 and 13 disclose a seal or seal assembly 86 which is smaller than the seal assembly 26 and particularly adapted to mount to smaller "oval" containers. The seal assembly 86 differs from the seal assembly 26 in providing smaller dispensing ports 88 and 90 in the flanged base 92, with the planar base panel 94 therebetween being relatively narrow and including two mounting apertures 96 which receive and retain two cooperating studs 97 depending from the correspondingly narrow center mounting plate 98 of the overlying closure cap 102.

The ports 88 and 90, similar to the ports 36 and 38, are formed, about the inner and side edges thereof, by the base panel 94 with the base panel 94, along the opposed sides of each of the ports, tapering or becoming gradually thinner until merging with or completely disappearing at a small pouring point or zone 100, thus eliminating any overhanging lip as might retain residue or impede the discharging flow. The tapered side portions of the panel which define the ports, as with regard to the previously described ports, tend to effectively guide the material toward the discharge point or zone 100 to control the flow therefrom.

The overlying closure cap 102 includes a pair of closure lids 104 and 106 which, aside from the size thereof, duplicate the previously described lids 58 and 60, and as such include depending peripheral sealing flanges 108 which, in cross section, duplicate the sealing flanges 72 and likewise engage, in a sealing manner, with the periphery of the ports 88 and 90 both along the length of the periphery defined by the base panel 94 and at the point or small area 100 defined by the inner wall of the base flange itself. This will be best noted in FIG. 13.

Each of the lids is also integral with the central mounting panel 98 along linear hinge lines 110, and includes the previously described positioning extensions or ears 112. These ears 112 will tend to bias the lids to the closed positions thereof until the lids are pivoted over center to the open position thereof, note FIGS. 3 and 4 of the previous embodiment.

As with the seal assembly 26, the seal assembly 86, with the lids closed, presents a planar recessed upper surface particularly adapted for the stacking of containers.

FIGS. 14–18 illustrate a slightly different embodiment wherein the seal or seal assembly 116 is round and adapted to mount to a cylindrical container.

The flanged base 118 of the assembly 116 includes a planar base panel 120 which, to one side of an imaginary line transversely thereacross, has an enlarged dispensing port 122 defined therethrough, and to the other side thereof has a port comprising a series of small openings 124 for a controlled sprinkling or shaking of the contents from the associated container. The port openings 124 are defined within the confines of the panel 120. The port 122, at the extreme point or zone 126 from the inner edge 128 thereof, is defined by the inner wall 130 of the peripheral upstanding edge flange 132. The opposed sides of the large dispensing port 122 are defined by tapering or progressively narrowing side portions 134 of the plate 120 which, as with regard to the previously described pouring ports, effectively guide the material to the unencumbered discharge point or zone 126 which is free of any overhanging lip-like portions as might collect residue.

As with the previously described embodiments, the peripheral flange 132 will define a downwardly directed continuous groove thereabout for mounting to an underlying container, and may have, integral with the outer wall of the flange, a depending lift tab 136 which will lie against the outer surface of the container.

The closure cap 138 is defined by two arcuate or generally semi-circular lids 140 and 142 which are integrally joined along a centrally located living hinge 144. The lid 140, slightly larger than the lid 142, includes a depending integral sealing flange 146 which engages within the port 122 peripherally thereabout. This flange 146 is formed in the manner of the previously described flanges 72 and 108, and similarly includes an outwardly projecting peripheral rib 148 which snap-locks, in a sealing manner, to the edge of the port 122 defined both by the base plate 120 and by the inner wall 130 of the flange 132 at the point or area 126.

The lid 142 includes a plurality of depending plugs 150 corresponding in number to the sprinkler port openings 124 and engaged therein and therethrough. These plugs 150 include enlarged slightly flared heads, best noted in FIG. 18, which, through peripheral ribs thereon, snap-lock to the base panel 120 after forced reception through the apertures 124.

So constructed, each of the lids 140 and 142, acts as a mounting panel securing the cap 138 to the base 118 while the other lid is manipulated between the closed and open position. In order to bias and retain each of the lids in both the open and closed positions thereof, each lid is provided with a single positioning extension or ear 152 integral and coplanar with the corresponding lid. The ears are positioned to the opposite ends of the central hinge 144 and extend from the lid integral therewith into an ear defining recess in the opposed lid to the opposite side of the hinge 144. Each of these positioning ears, through the inner edge cut lines 154, is also partially defined from the lid from which it extends to provide enhanced flexure for facilitating movement of the corresponding lid to the two retained positions thereof. Each ear, noting FIG. 17, overlies the central portion of the base panel 120 between the multiple port openings 124 and the single enlarged port 122 whereby a positive surface against which the ears 152 can flex and bias is provided.

In order to facilitate manipulation of the lids 140 and 142, each can be provided with an integral handle 156 extending partially along the outer edge thereof to a point above the peripheral flange 132 of the base 118. The upper surfaces of the lids 140 and 142 are coplanar and recessed below the upper edge of the base flange 132 to provide a stacking surface for a superimposed container.

The foregoing is illustrative of the principles of the invention. While several embodiments have been disclosed and discussed in detail, it is to be appreciated that other embodiments, falling within the parameters of the following claims, are also to be considered within the scope of the invention.

We claim:

1. A dispensing seal for flowable material, comprising:

a base including a planar base panel having upper and lower faces and a peripheral flange projecting upwardly relative to said upper face of said base panel, said flange having an inner wall surface;

a dispensing port defined through said base panel, said dispensing port having a periphery, a portion of said periphery defining a pouring point coextensive with said peripheral flange, the remainder of said periphery of said discharge port being spaced from said peripheral flange;

a closure cap overlying said base panel upper face and being substantially coextensive therewith, said cap including a closure lid overlying said dispensing port and being selectively movable between a closed position sealing said dispensing port and an open position remote from said dispensing port for permitting discharge therethrough, said lid, when in said closed positions, being coplanar with said closure cap and presenting a recessed upper surface relative to said peripheral flange of said base, said lid having a sealing flange thereon engageable within and sealing said dispensing port when in said closed position, said sealing flange sealing both to said flange inner wall surface at said pouring point, and to said base panel at the remainder of said periphery of said dispensing port.

2. A seal assembly as in claim 1, wherein said dispensing port comprises two of said dispensing ports, each at spaced locations on said base panel, and wherein said lid comprises two of said lids, each of said lids being associated with one of said dispensing ports.

3. A seal assembly as in claim 2, wherein said lids have substantially parallel, spaced hinges, said hinges being spaced by a mounting plate which is removable secured to said base panel.

4. A seal assembly as in claim 3, further including at least one positioning ear associated and integral with each said lid, each said positioning ear extending coplanar from said associated lid beyond said hinge toward said mounting plate, each of said ears retaining said associated lid in both the open and closed position thereof, while allowing physical movement between said positions.

5. A seal assembly as in claim 3, further including mounting apertures defined through said base panel, and mounting studs integral with and depending from said mounting panel of said cap and snap-locked within said apertures wherein said cap is secured to said base panel.

6. A seal assembly as in claim 1, further including a pair of spaced, parallel retaining projections extending from a lower surface of one of said lids, each said retaining projection including an edge tab extending toward the other said retaining projection, and an implement having a handle removably mounted between said retaining projections and intermediate said one of said lids and said edge tabs.

* * * * *